US007959271B2

(12) United States Patent
Steinmetz et al.

(10) Patent No.: US 7,959,271 B2
(45) **Date of Patent: *Jun. 14, 2011**

(54) PRINTING-FLUID CONTAINER

(75) Inventors: Charlie Steinmetz, Corvallis, OR (US); Daniel W. Petersen, Philomath, OR (US); Curt Gonzales, Corvallis, OR (US); Peter G. Hwang, Vancouver, WA (US); Lisa M. Hanson, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/607,750

(22) Filed: Nov. 30, 2006

(65) Prior Publication Data

US 2007/0070156 A1 Mar. 29, 2007

Related U.S. Application Data

(63) Continuation of application No. 10/770,605, filed on Jan. 29, 2004, now Pat. No. 7,147,310, which is a continuation-in-part of application No. 10/632,728, filed on Jul. 31, 2003, now Pat. No. 6,962,408, which is a continuation-in-part of application No. 10/060,821, filed on Jan. 30, 2002, now Pat. No. 6,648,460.

(51) Int. Cl.
*B41J 2/175* (2006.01)

(52) U.S. Cl. ..... 347/86; 347/84; 347/85

(58) Field of Classification Search ..... 347/84, 347/85, 86

See application file for complete search history.

(56) References Cited

U.S. PATENT DOCUMENTS

| | | | | |
|---|---|---|---|---|
| 4,568,954 | A * | 2/1986 | Rosback | 347/86 |
| 5,317,339 | A * | 5/1994 | Braun et al. | 347/87 |
| 5,734,401 | A * | 3/1998 | Clark et al. | 347/86 |
| 6,113,228 | A * | 9/2000 | Pawlowski et al. | 347/81 |
| 6,471,333 | B1 | 10/2002 | Powell et al. | |
| 6,505,926 | B1 * | 1/2003 | Trafton et al. | 347/86 |
| 6,509,401 | B1 * | 1/2003 | Jenewein et al. | 524/116 |
| 6,511,167 | B1 | 1/2003 | Kitabatake et al. | |
| 6,530,654 | B2 | 3/2003 | Kitabatake et al. | |
| 7,104,630 | B2 * | 9/2006 | Steinmetz et al. | 347/49 |
| 7,452,061 | B2 * | 11/2008 | Childers et al. | 347/86 |
| 2002/0109760 | A1 | 8/2002 | Miyazawa et al. | |
| 2003/0025773 | A1 * | 2/2003 | Koizumi et al. | 347/85 |
| 2003/0083203 | A1 | 5/2003 | Hashimoto et al. | |

FOREIGN PATENT DOCUMENTS

| | | | |
|---|---|---|---|
| EP | 1055520 | A1 * | 11/2000 |
| EP | 1232871 | | 10/2002 |

OTHER PUBLICATIONS

EPO opposition, appeal re: European patent application 04779378.

* cited by examiner

*Primary Examiner* — Laura E Martin

(57) ABSTRACT

A printing-fluid container includes a reservoir having a leading surface with an outer perimeter. Redundant interface elements are recessed from the leading surface interior the outer perimeter.

24 Claims, 10 Drawing Sheets

PRINTING-FLUID CONTAINER

CROSS REFERENCE TO RELATED APPLICATIONS

This application is a continuation of U.S. application Ser. No. 10/770,605, filed Jan. 29, 2004 now U.S. Pat. No. 7,147,310, which is a continuation-in-part of U.S. application Ser. No. 10/632,728, filed Jul. 31, 2003 now U.S. Pat. No. 6,962,408, which is a continuation-in-part of U.S. application Ser. No. 10/060,821, filed Jan. 30, 2002 now U.S. Pat. No. 6,648,460. The contents of the above referenced applications are incorporated by reference.

BACKGROUND

Inkjet printing systems often utilize one or more replaceable ink containers that hold a finite volume of ink. An ink container can be replaced if the ink container is unable to deliver ink. For example, an ink container can be replaced if all of the ink in the ink container is used and the ink container is empty. Many known ink containers are unable to deliver all of the ink in the ink container and are considered to be effectively empty although some ink remains in the ink container. Such ink containers can be replaced when the ink container ceases to adequately deliver ink. Users generally prefer ink containers that do not have to be frequently replaced. Furthermore, users generally prefer ink containers that are relatively easy to replace when replacement is necessary.

DETAILED DESCRIPTION

Figure 1:
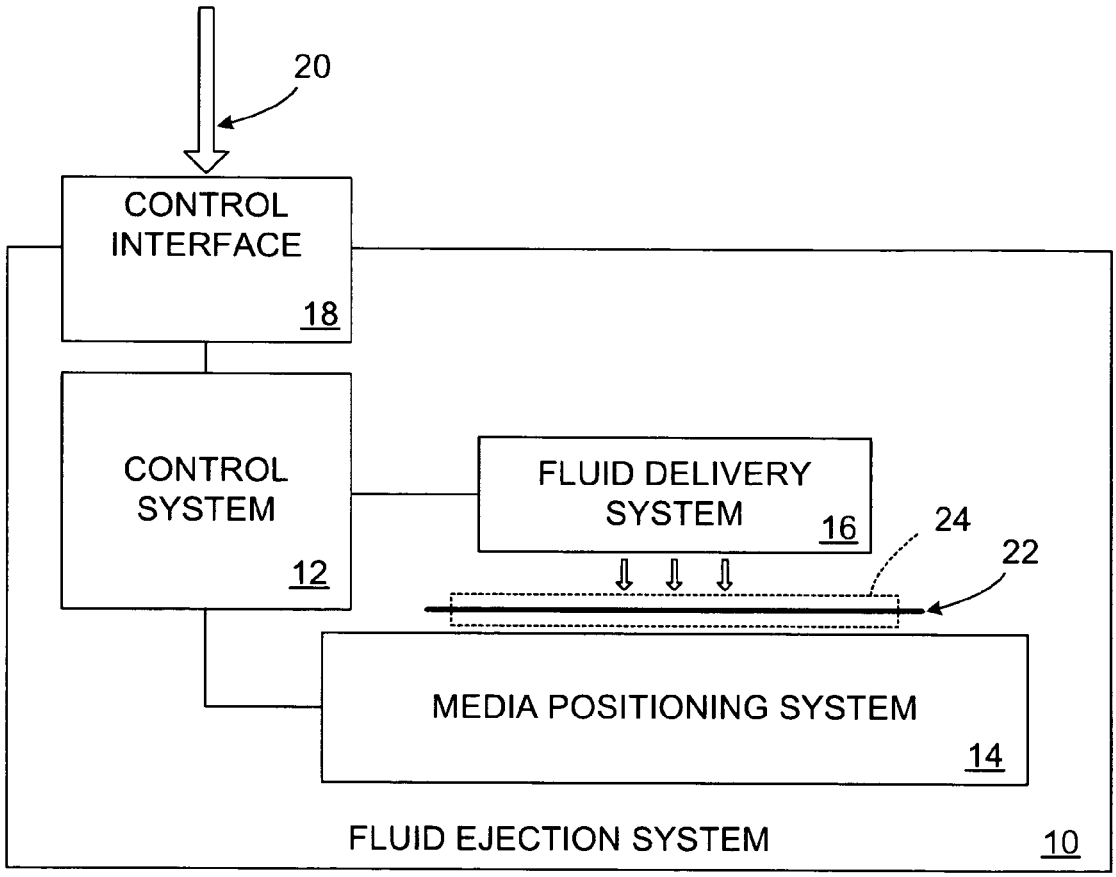
FIG. 1 is a schematic view of a fluid ejection system according to an embodiment of the present invention.

FIG. 1 schematically shows a fluid ejection system 10. Although fluid ejection systems may be configured to eject a variety of different fluids onto a corresponding variety of different media in various embodiments, this disclosure focuses on an exemplary printing system that is used to eject, or print, ink onto paper. However, it should be understood that other printing systems, as well as fluid ejection systems designed for nonprinting applications, are also within the scope of this disclosure.

Fluid ejection system 10 includes a control system 12, a media positioning system 14, a fluid delivery system 16, and a control interface 18. Control system 12 may include componentry, such as a printed circuit board, processor, memory, application specific integrated circuit, etc., which effectuates fluid ejection corresponding to a received fluid ejection signal 20. Fluid ejection signals may be received via a wired or wireless control interface 18, or other suitable mechanism. The fluid ejection signals may include instructions to perform a desired fluid ejection process. Upon receiving such a fluid ejection signal, the control system may cause media positioning system 14 and fluid delivery system 16 to cooperate to eject fluid onto a medium 22. As one example, a fluid ejection signal may include a print job defining a particular image to be printed. The control system may interpret the print job and cause fluid, such as ink, to be ejected onto paper in a pattern replicating the image defined by the print job.

Media positioning system 14 may control the relative positioning of the fluid ejection system and a medium onto which the fluid ejection system is to eject fluid. For example, media positioning system 14 may include a paper feed that advances paper through a printing zone 24 of the fluid ejection system. The media positioning system may additionally or alternatively include a mechanism for laterally positioning a printhead, or other suitable device, for ejecting fluid to different areas of the printing zone. The relative position of the medium and the fluid ejection system may be controlled, so that fluid may be ejected onto only a desired portion of the medium. In some embodiments, media positioning system 14 may be selectively configurable to accommodate two or more different types and/or sizes of media.

Figure 2:
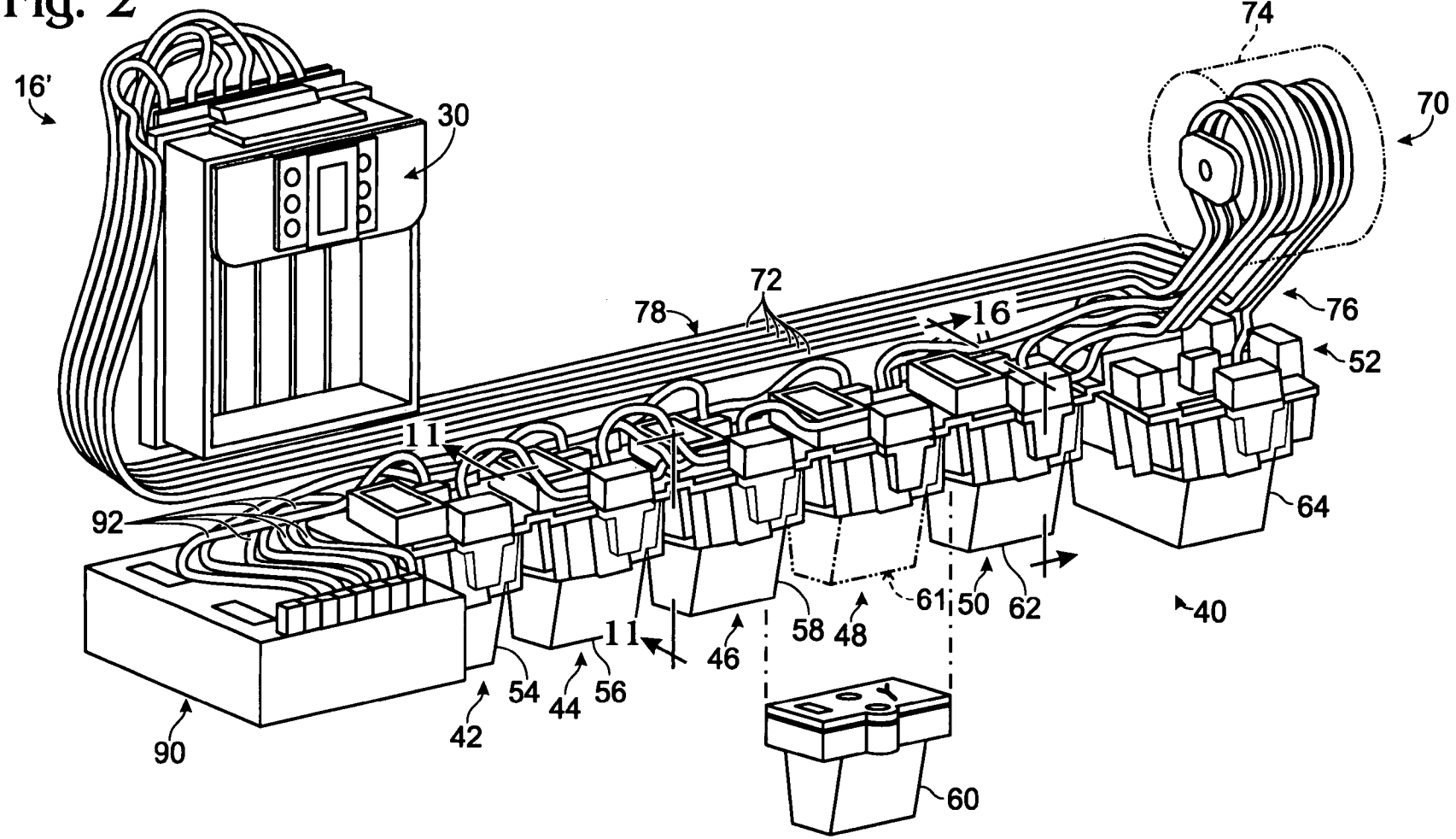
FIG. 2 is a somewhat schematic view of an embodiment of a printing-fluid delivery system as used in the fluid ejection system of FIG. 1.

FIG. 2 schematically shows an exemplary fluid delivery system in the form of a printing-fluid delivery system 16'. The printing-fluid delivery system includes a scanning printhead 30, which may include one or more nozzles adapted to receive a printing-fluid from a fluid supply and eject the printing-fluid onto a print medium. A nozzle may be associated with a fluid ejector, such as a semiconductor resistor, that is operatively connected to a control system. The control system may selectively cause the fluid ejector to heat printing-fluid that is delivered to the fluid ejector. In embodiments that utilize a resistor as a fluid ejector, the resistor may be activated by directing current through the resistor in one or more pulses. Heated printing-fluid may at least partially vaporize and create a printing-fluid bubble. Expansion of the printing-fluid bubble may cause some of the printing-fluid to be ejected out of the corresponding nozzle onto the print medium. A printhead may be adapted to print a single color of ink, two or more different colors of ink, a preconditioner, fixer, and/or other printing fluid. It is within the scope of this disclosure to utilize other mechanisms for ejecting fluid onto a medium, and printhead 30 is provided as a nonlimiting example. For example, a printhead may include a fluid ejector configured to effectuate fluid ejection via a nonthermal mechanism, such as vibration.

Printing-fluid delivery system 16' includes an off-axis ink-supply station 40. An "off-axis" ink-supply may be located apart from a printhead so that the printhead can scan across a printing zone while the ink-supply remains substantially stationary. Such an arrangement may decrease the total weight of a printhead assembly compared to a printhead assembly that includes an on-axis ink-supply. A relatively light printhead assembly may require relatively less energy to move, while moving faster, quieter, and/or with less vibration than a printhead with an integrated on-axis ink-supply. An off-axis ink-supply may be positioned for easy access to facilitate replenishing the ink-supply. An ink-supply can be sized to accommodate a desired volume of ink. As explained in more detail below, an ink-supply station may be configured for front loading so that a printing-fluid container can be laterally inserted into a printing system. The stationary position and relatively easy access of an off-axis ink-supply can allow for relatively large volumes of ink to be stored and delivered.

An off-axis ink-supply may include containers for storing and delivering one or more colors of ink as well as other printing-fluids. For example, ink-supply station 40 includes six ink-container bays configured to accommodate six corresponding ink containers. In the illustrated embodiment, ink-supply station 40 includes yellow bay 42, dark-magenta bay 44, light-magenta bay 46, dark-cyan bay 48, light-cyan bay 50, and black bay 52, which respectively are adapted to receive yellow ink container 54, dark-magenta ink container 56, light-magenta ink container 58, dark-cyan ink container 60, light-cyan ink container 62, and black ink container 64. Other printing systems may be designed for use with more or fewer colors, including colors different than those described above. It should be understood that as used herein, "ink" may be used in a general sense to refer to other printing fluids, such as preconditioners, fixers, etc., which may also be held by an ink-container and delivered via a fluid delivery system. Two or more ink containers holding a printing fluid of the same color and/or type may be used in the same printing system. In some embodiments, one or more of the ink-container bays may be sized differently than another ink-container bay. For example, in the illustrated embodiment, black bay 52 is larger than the other ink-container bays, and therefore can accommodate a relatively larger ink container. As is described in more detail below, a particular ink-container bay may accommodate ink containers of differing sizes.

Ink delivery system 16' includes an ink transport system 70 configured to move ink from the ink-supply station to the printhead. In some embodiments, the ink transport system may be a bi-directional transport system capable of moving ink from the ink-supply station to the printhead and vice versa. An ink transport system may include one or more transport paths for each color of ink. In the illustrated embodiment, ink transport system 70 includes a tube 72 that links an ink container of the ink-supply station to the printhead. In the illustrated embodiment, there are six such tubes that fluidically couple the ink containers to the printhead. A tube may be constructed with sufficient length and flexibility to allow the printhead to scan across a printing zone. Furthermore, the tube may be at least partially chemically inert relative to the ink that the tube transports.

The ink transport system may include one or more mechanisms configured to effectuate the transport of ink through an ink transport path. Such a mechanism may work to establish a pressure differential that encourages the movement of ink. In the illustrated embodiment, fluid transport system 70 includes a pump 74 configured to effectuate the transport of ink through each tube 72. Such a pump may be configured as a bi-directional pump that is configured to move ink in different directions through a corresponding ink transport path.

An ink transport path may include two or more portions. For example, each tube 72 includes a static portion 76 linking an ink container to the pump and a dynamic portion 78 linking the pump to the printhead. The transport path may also include a pumping portion that effectively links the static portion to the dynamic portion and interacts with the pump to effectuate ink transport. The individual portions of an ink transport path may be physically distinct segments that are fluidically linked by one or more interconnects. In some embodiments, a single length of tube linking an ink container to the printhead may be functionally divided into two or more portions, including static and dynamic portions. In the illustrated embodiment, dynamic portion 78 is adapted to link a stationary ink-supply station to a scanning printhead that moves during printing, and therefore the dynamic portion is configured to move and flex with the printhead. The static portion, which links a stationary ink-supply station to a stationary pump, may remain substantially fixed.

An ink container of ink-supply station 40 may include a vent configured to facilitate the input and output of ink from the container. For example, a vent may fluidically couple the inside of an ink container to the atmosphere to help reduce unfavorable pressure gradients that may hinder ink transport. Such a vent may be configured to limit ink from exiting the ink container through the vent, thus preventing unnecessary ink dissipation. An exemplary vent in the form of a fluidic interface is described in more detail below.

Printing-fluid delivery system 16' may include a vent chamber 90 configured to reduce ink evaporation and/or other ink loss. Each ink container of ink-supply station 40 may be fluidically coupled to vent chamber 90 via a tube 92 linking the vent of that ink container to the vent chamber. In other words, an ink-container vent may be connected to the vent chamber to facilitate ink transport between an ink container and the printhead. The vent chamber may decrease unfavorable pressure gradients while limiting evaporation of ink to the atmosphere. In some embodiments, vent chamber 90 may include a labyrinth that limits ink loss. Vent chamber 90 may be fixed in a substantially stationary position.

As mentioned above, FIG. 2 somewhat schematically depicts printing-fluid delivery system 16'. The precise arrangement of the constituent elements of the printing-fluid delivery system may be physically arranged according to a desired industrial design. Similarly, the individual elements may vary from the illustrated embodiments while remaining within the scope of this disclosure. Size, shape, access, and aesthetics are among factors that may be considered when designing a fluid ejection system that utilizes a printing-fluid delivery system according to the present disclosure. Though described and illustrated with reference to an off-axis ink supply, it should be understood that many of the principles herein described are applicable to on-axis ink supplies. The off-axis ink supply is provided as a nonlimiting example, and on-axis ink supplies are also within the scope of this disclosure.

FIG. 2 shows uninstalled dark-cyan ink container 60 in solid lines. As indicated in dashed lines at 61, the dark-cyan ink container may be installed into ink-supply station 40. Similarly, the other ink containers of ink-supply station 40 may be selectively installed and uninstalled. In this manner, an exhausted ink-supply may be replenished by installing a full ink container, thus extending the operational life of a fluid ejection system. The ink-supply station may be configured so that the individual ink containers may be exchanged independently of one another. For example, if only one ink container becomes exhausted, that ink container can be replaced while leaving the other ink containers in place. Furthermore, a ganged ink supply, which accommodates two or more different printing fluids and/or colors in a common container assembly, may be seated in an ink container bay. It should be understood that while the orientation of FIG. 2 shows ink container 60 being installed into ink-supply station 40 in a generally vertical direction, this is not necessarily required. Ink-supply station 40 may be orientated to receive ink-containers that are laterally installed.

An ink delivery system may include an ink-level monitor configured to track the amount of ink available for delivery. An ink-level monitor may be configured to individually monitor individual ink containers, groups of ink containers supplying the same color of ink, and/or the collective ink-supply of the system. The ink-level monitor may cooperate with a notification system to inform a user of the status of the ink level, thus enabling a user to assess ink levels and prepare for ink replenishment. Furthermore, as described in more detail below, an ink container may include a memory and an associated electrical interface, and information regarding the ink-level of an ink container may be stored in such a memory and conveyed via the electrical interface.

Figure 3:
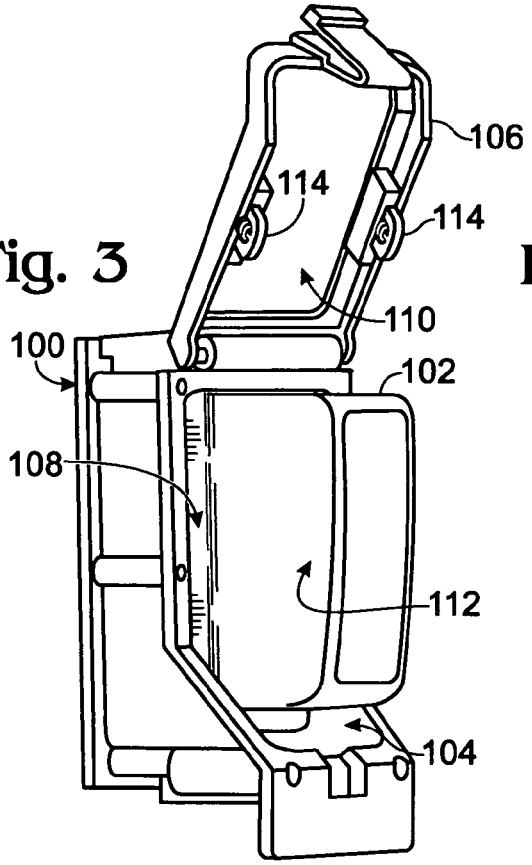
FIG. 3 shows an embodiment of a printing-fluid container bay in an open position as used in the fluid delivery system of FIG. 2.
Figure 4:
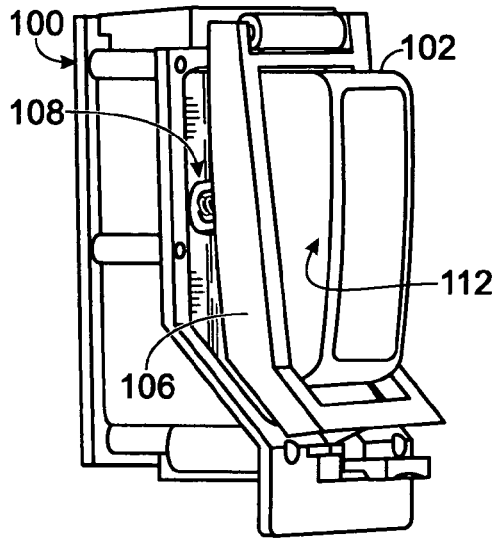
FIG. 4 shows the printing-fluid container bay of FIG. 3 in a closed position.

FIGS. 3 and 4 show a more detailed view of an exemplary ink-container bay 100 configured to selectively receive an ink container 102. FIG. 3 shows ink-container bay 100 in an open position and FIG. 4 shows the ink-container bay in a closed position, in which the ink-container bay is retaining ink container 102. The ink-container bay may include a seat 104 adapted to pair with a portion of an ink container. In other words, seat 104 and a portion of the ink container may be complementarily configured so that the ink container can be docked in the seat. The seat may be sized and shaped to mate with the size and shape of a portion of an ink container, such as an ink-container lid and/or a shoulder portion of an ink-container reservoir body. The ink-container bay may include a latching member 106 adapted to hold the ink container in place. In the illustrated embodiment, latching member 106 pivots on a hinge to engage a rim portion 108 of ink container 102. Rim portion 108 is an example of a latching surface, which may be engaged by a latching member to retain an ink container in an ink-container bay. In the illustrated embodiment, latching member 106 includes an open void 110 through which a rear-portion 112 of ink container 102 may extend. A latching member, or a combination of two or more latching members, configured to hold an ink container in place may be configured to accommodate ink containers having different sizes. In some embodiments, a latching member may engage one or more portions of an ink container, such as a latching surface of rim portion 108. In the illustrated embodiment, latching member 106 includes a plunger 114 configured to engage rim portion 108 on each side of the ink container, while rear portion 112 extends through open void 110. Plunger 114 includes a resilient member adapted to apply seating pressure to ink container 102 when latching member 106 is in a closed position. In some embodiments, two or more latching members may be separately movable components that facilitate large rear portions, or a unitary latching member can be configured to accommodate large rear portions. Furthermore, in some embodiments, alternative or additional latching mechanisms may be used to hold an ink container in place.

Figure 5:
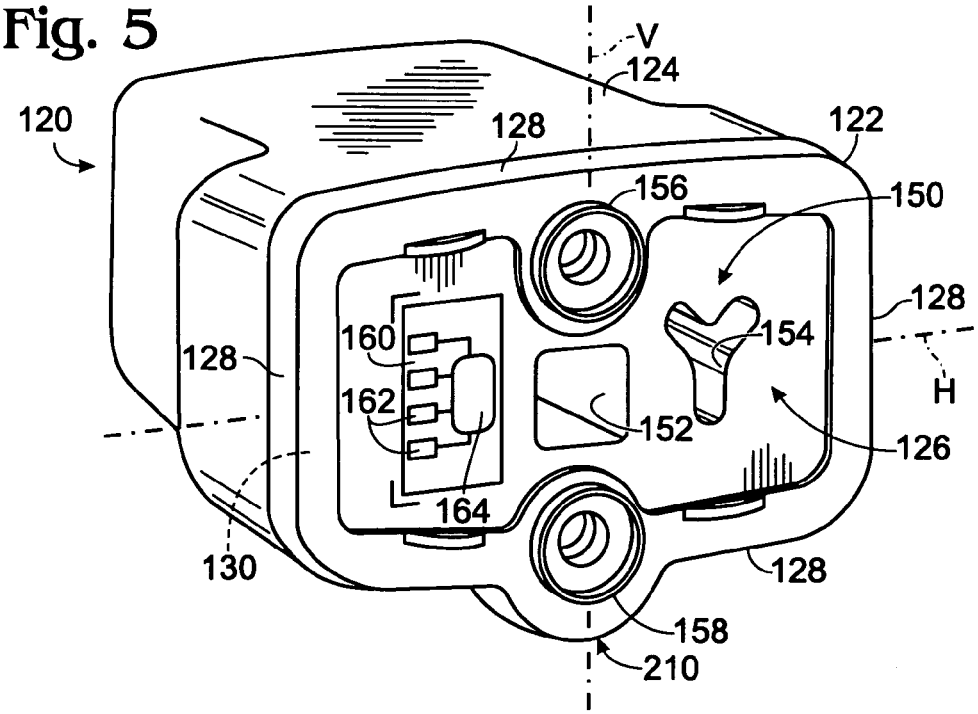
FIG. 5 shows a front isometric view of a printing-fluid container according to an embodiment of the present invention.
Figure 6:
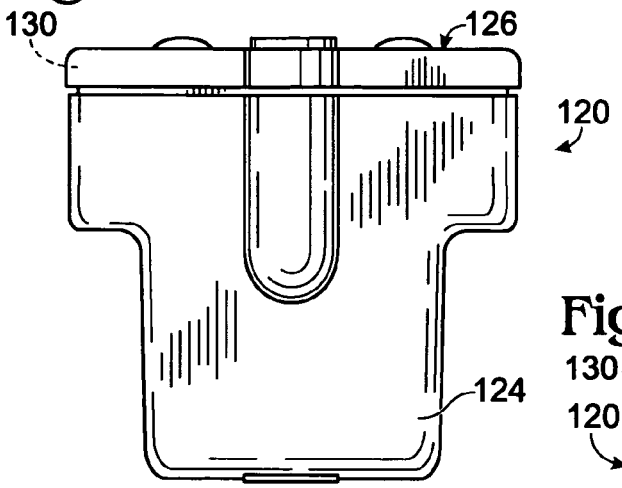
FIG. 6 shows a bottom view of the printing-fluid container of FIG. 5.
Figure 7:
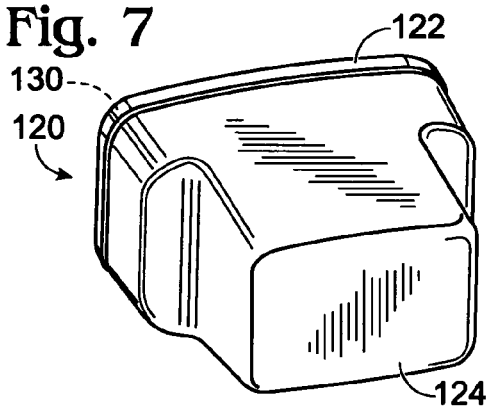
FIG. 7 shows a back isometric view of the printing-fluid container of FIG. 5.

FIGS. 5-7 show an ink container 120 that includes an ink-container lid 122 and an ink-container reservoir body 124 that are complementarily configured to collectively define a bounded volume in which ink may be contained. The ink-container lid and the reservoir body may be collectively referred to as a reservoir, ink reservoir, or printing-fluid reservoir. In some embodiments, such a reservoir may be formed from a single structural piece, or two or more pieces that are connected differently than shown in the illustrated embodiment. Lid 122 may include an inner-side that faces towards the inside of the ink container when the reservoir body is coupled to the lid. The lid may include one or more portions adapted to engage a reservoir body or otherwise secure the lid to the reservoir body. In some embodiments, a lid and a reservoir body may be releasably secured to one another while some embodiments may utilize a lid and a reservoir body that are connected in a substantially permanent arrangement. A gasket or other suitable seal may be fit at an interface between lid 122 and reservoir body 124 to enhance the ability of the lid and the reservoir body to hold a volume of ink or other printing fluid.

Ink container 120 may be configured as a free ink container adapted to hold a free volume of ink. As used herein, a free volume of ink refers to a volume of ink that is held within a container without the use of a sponge, foam, ink sack, or similar intermediate holding apparatus and/or backpressure applying device. A free ink container can be substantially "open" within its boundaries, thus permitting a relatively large percentage of the enclosed volume to be filled with ink, which can flow freely within the reservoir. As described in more detail herein, the design of ink container 120 allows a free volume of ink to be extracted from the ink container and delivered to a printhead. Furthermore, as described below, a very high percentage of a free volume of ink can be extracted from a free ink container, thus limiting the amount of stranded ink.

Ink-container lid 122 includes an outer-face 126 that faces away from the contents of an ink container. Outer-face 126 can be designed to be the "forward" facing portion of an ink container when the ink container is installed in a corresponding ink-container bay. Accordingly, the outer-face may be referred to as a leading surface of the ink container or as being aligned with a leading plane of the ink container. In some embodiments, a portion of a printing-fluid container other than a lid may be the leading surface of the printing-fluid container.

Ink-container lid 122 can be formed with an outer-face 126 that has a substantially planar profile. As described in more detail below, the outer-face may include one or more recesses adapted to provide mechanical alignment and/or keying. The outer-face may additionally or alternatively include holes that pass from the outside of an ink container to the inside of an ink container. Such holes may be used as fluidic interfaces for moving a printing fluid and/or air from inside the ink container to outside the ink container, and vice versa. An entry point of each recess, hole, and/or other interface may be arranged on the same leading surface. In some embodiments, the entry points to various interfaces of a printing-fluid container may be located on towers that are raised above another portion of the leading surface. Such an embodiment may not have a substantially planar profile, yet the entry point of various mechanical, fluidic, and/or electrical interfaces may be aligned on a common leading plane. In some embodiments, the entry point to each interface may be arranged within an acceptable distance on either side of a leading plane. For example, in some embodiments, any forward or backward variation of an interface's entry point relative to the entry point of another interface may be less than approximately 5 mm, while in most embodiments such variations may be less than approximately 2 mm, or even 1 mm. An ink-container lid that has an outer-face with a substantially planar profile may be referred to as a substantially planar ink-container lid, although such an ink-container lid can have a measurable thickness, an irregular inner-side, and/or one or more surface deviations on its outer-face.

Ink-container lid 122 can be constructed as a unitary structural piece 130, as opposed to a combination of two or more structural pieces. Such a piece may be molded, extruded, or otherwise formed from a material selected for strength, weight, workability, cost, compatibility with ink, and/or other considerations. For example, the lid may be injection molded from a suitable synthetic material. Construction from a unitary structural piece produces an ink-container lid in which an inner-side and an outer-face are opposite sides of the same piece of material.

An ink-container lid constructed from a unitary structural piece may be fit with complementary auxiliary components. For example, a gasket may be used to promote a fluid-tight seal between the ink-container lid and a reservoir body. A fluidic interface formed in a unitary structural piece may be fit with a seal configured to selectively seal ink within the ink container. The seal may take the form of a septum, a ball and septum assembly, or other mechanism. A memory device may be affixed to ink-container lid 122 and the ink-container lid may be equipped with an electrical interface for transferring data to and from the memory device. Such auxiliary components can be adapted to integrally cooperate with the unitary structural piece that defines the general size and shape of the ink-container lid.

Figure 8:
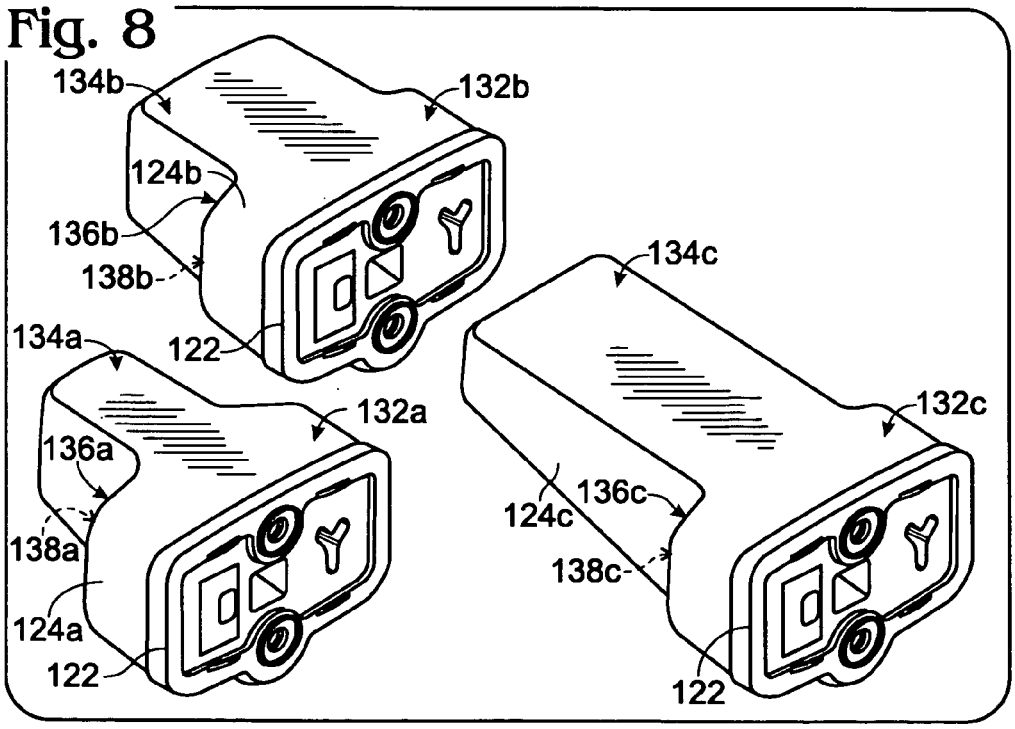
FIG. 8 shows a set of three printing-fluid containers formed by combining three different reservoir bodies with three similarly configured lids.

Ink container 120 includes a reservoir body 124 that cooperates with ink-container lid 122 to provide a structural boundary for containing a volume of ink. As described in more detail below, the various mechanical, electrical, and fluidic interfaces of ink container 122 may be arranged on an ink-container lid. In other words, interface functionality of an ink container can be substantially consolidated to an ink-container lid, thus providing design freedom with respect to the reservoir body. For example, FIG. 8 shows ink-container lid 122 with three differently sized reservoir bodies 124*a*-124*c*. As can be seen, ink containers with different ink capacities can be formed by combining different reservoir bodies with the same ink-container lid. Therefore, an ink container may be selectively sized to provide a desired ink capacity. Furthermore, two or more ink containers having different ink capacities may be alternately installed into the same ink-container bay, thereby providing increased printer configuration flexibility. Standardizing ink-container lid design may also help to reduce manufacturing costs. It should be understood that differently configured ink-container lids are also within the scope of this disclosure.

A portion of an ink-container reservoir body can be configured with a standard size and shape while another portion is configured with a size and shape that varies between two or more configurations. For example, FIG. 8 shows reservoir bodies 124*a*-124*c* that respectively include shoulder portions 132*a*-132*c*, which are similarly configured with respect to one another. Such shoulder portions have a width that is substantially the same as a corresponding width of the ink-container lid. Reservoir bodies 124*a*-124*c* also respectively include rear portions 134*a*-134*c*, which are differently configured with respect to one another. Such rear portions have a width that is less than a corresponding width of the ink-container lid. The shoulder portions and the rear portions are joined by rim portions 136*a*-136*c* that include latching surfaces 138*a*-138*c*. Configuring a portion of a reservoir body, such as shoulder portions 132*a*-132*c*, with a standard size and shape improves compatibility between different ink containers, similar to the compatibility provided by a standard ink-container lid 122. For example, different ink containers that have similarly configured shoulder portions, but which may have rear portions of differing sizes, can be secured by the same latching member.

Reservoir body 124 may be configured to serve as a handling portion of an ink container. An ink container may be physically held and manipulated when an ink container is loaded and unloaded from an ink-container bay of an ink-supply station. An ink container may also be held at a gripping portion during a refill process, during maintenance, or during various other situations. Reservoir body 124 may be used to handle the ink container in such instances. The reservoir body may be sized and shaped for comfortable and secure gripping. Furthermore, a surface of the reservoir body may be adapted to enhance gripping traction, such as by texturing the surface. The shape of the reservoir body may also facilitate inserting the printing-fluid container into a corresponding ink-container bay of an ink supply station. For example, the lack of symmetry across a horizontal axis helps define a top and a bottom that a user may easily appreciate, thus simplifying installation of the ink-container into a corresponding ink-container bay.

As mentioned above, an ink-container lid may include one or more interface features corresponding to complementary features of an ink-container bay adapted to receive the ink container. For example, as shown in FIG. 5, ink-container lid 122 includes an interface package 150 comprising an alignment pocket 152, a keying pocket 154, a top fluidic interface in the form of an air-interface 156, a bottom fluidic interface in the form of an ink-interface 158, and an electrical interface 160. As used herein, an ink-interface may also be used for air passage and/or an air-interface may be used for the passage of printing fluid. Interface package 150 is positioned interior an outer perimeter 128 of ink-container lid 122. In other words, the constituent features of interface package 150 are not positioned around a lateral edge of the ink-container lid, or elsewhere on the reservoir body.

As described in more detail below, interface package 150 is an exemplary collection of mechanical, fluidic, and electrical interfaces adapted to enable and/or enhance ink delivery from the ink container. Interface package 150 is provided as a nonlimiting example, and other arrangements may include additional and/or alternative features. Furthermore, the positioning of the various features may vary from the illustrated embodiment.

FIG. 5 shows an exemplary alignment pocket 152 configured to position an ink container in a desired location with a desired orientation. Such positioning facilitates the mating of an ink container with an ink-container bay. In particular, an alignment pocket may be used to position an ink container in the proper position so that various aspects of the ink container align for coupling with corresponding aspects of an ink-container bay. For example, keying pocket 154 can be aligned with a corresponding key post of the ink-container bay. Air-interface 156 and ink-interface 158 can be aligned with corresponding air and ink connectors of the ink-container bay. Electrical interface 160 can be aligned with a corresponding electrical contact of the ink-container bay.

Alignment pocket 152 may be recessed from a leading surface of the printing-fluid container, thus providing a robust interface that is less prone to damage compared to a tower interface protruding from the leading surface of the printing-fluid container. In some embodiments, the alignment pocket may recess from a leading surface by 10 millimeters, 15 millimeters, or more. The cross-sectional width of the alignment pocket may be selected to achieve a desired ratio of length to width. In particular, a length/width ratio of approximately 1.5 has been found to limit rotation of a printing-fluid container when mated with a corresponding alignment member. Ratios ranging between 1.0 and 4.0 may be suitable in some embodiments, with ratios between 1.2 and 2.0 being appropriate in most circumstances. The width of the alignment pocket may be selected to be large enough to accommodate alignment members that are mechanically strong enough to resist twisting forces that could result in rotation of the printing-fluid container and misalignment of various interface features.

Figure 9:
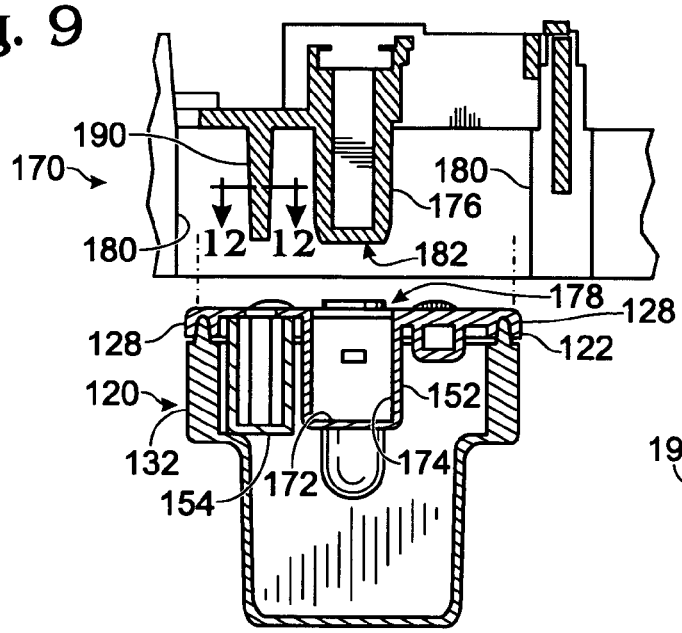
FIGS. 9-11 show top cross-section views of a printing-fluid container being seated into a printing-fluid container bay according to an embodiment of the present invention.
Figure 10:
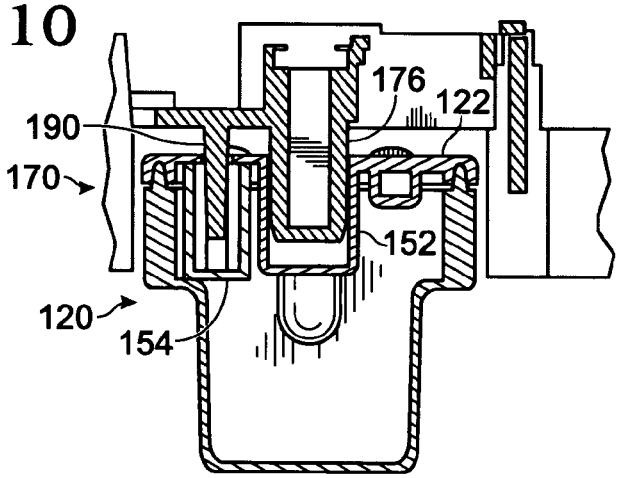
Figure 11:
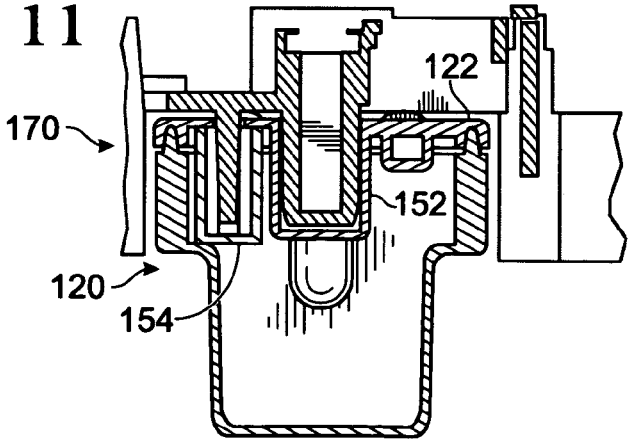
Figure 14:
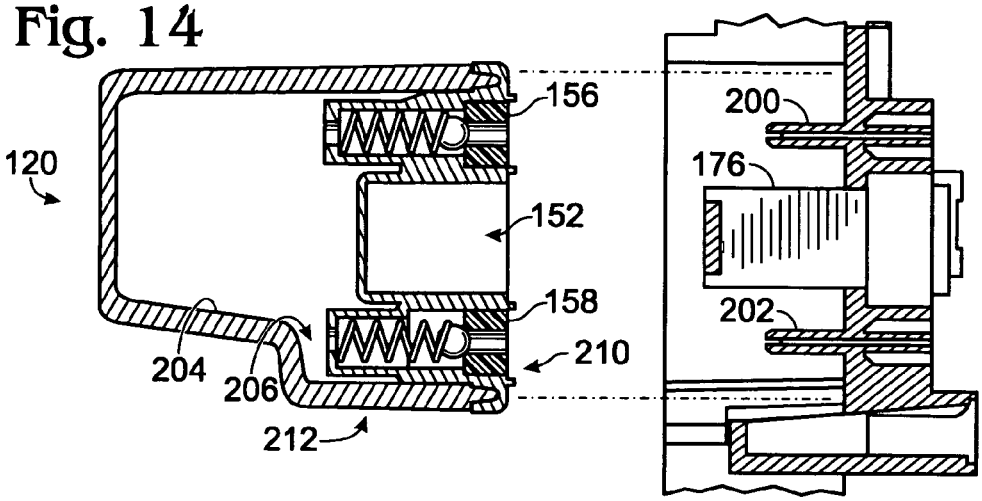
FIGS. 14-16 show side cross-section views of a printing-fluid container being seated into a printing-fluid container bay according to an embodiment of the present invention.
Figure 15:
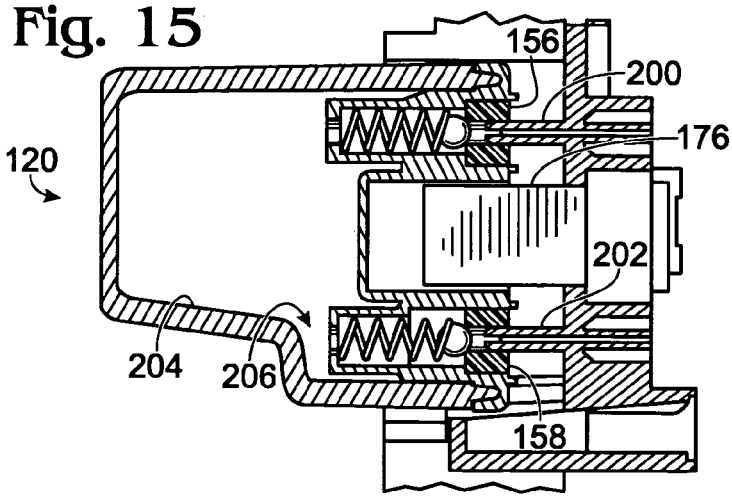
Figure 16:
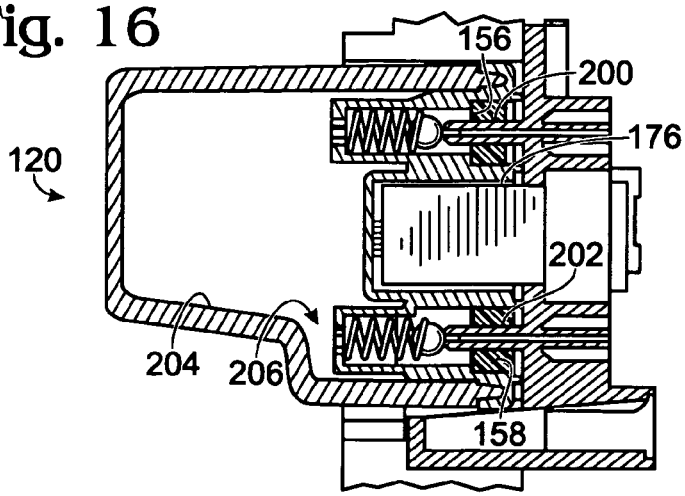

FIGS. 9-11 and 14-16 show a series of cross-section views in which ink container 120 is being seated into an ink-container bay 170. FIGS. 9-11 are top views showing ink container 120 moving from an unseated position to a seated position. Similarly, FIGS. 14-16 are side views showing ink container 120 moving from an unseated position to a seated position. Ink-container lid 122 includes an alignment pocket 152 recessed from a center portion of the ink-container lid. In the illustrated embodiment, alignment pocket 152 includes a terminal surface 172 and sidewalls 174 that recess from a generally planar outer-face, or leading surface. The alignment pocket can be sized so that it is deep enough to accommodate a corresponding outwardly-extending alignment member 176 of ink-container bay 170. Sidewalls 174 may be arranged perpendicular to the outer-face or one or more of the sidewalls may be tapered so that a cross-section area of an opening 178 of alignment pocket 152 is greater than a cross-section area of terminal surface 172.

A fit between alignment member 176 and alignment pocket 152 can be sufficiently tight so that when the alignment pocket engages the alignment member, ink-container lid 122 is effectively restricted to a desired movement path. In this manner, alignment of the ink-container lid and a corresponding ink-container bay can be ensured. The fit can be established by physical contact between portions of alignment pocket 152 and alignment member 176. Such contact may be along entire surfaces of the alignment pocket and the alignment member, as shown in the drawings. In some embodiments, contact may occur along less than entire surface portions. In some embodiments, mating of an alignment member with the alignment pocket may be less tight, and the alignment pocket may merely be sized to accommodate a projecting alignment member without tightly engaging the alignment member.

Ink-container lid 122 may include a progressive alignment mechanism, in which alignment of the ink-container lid becomes more precise as the ink-container lid is more completely seated in an ink-container bay. For example, outer perimeter 128 may be sized slightly smaller than corresponding sidewalls 180 of ink-container bay 170, and the ink-container bay may be configured to engage the ink-container lid before the alignment pocket tightly engages the alignment member. Therefore, the outer-perimeter can provide a course alignment for the ink-container lid. The fit between the ink container and sidewalls 180 can be relatively tolerant so that it is easy to initiate the course alignment. Although the course alignment may be less precise than the alignment provided by alignment pocket 172, the ink container can be in a greater range of positions when the course alignment is initiated compared to when fine alignment is initiated. The ink container and ink-container bay may be configured so that alignment pocket 152 is directed to a position to engage alignment member 176 by the course alignment interaction between outer-perimeter 128, shoulder portion 132, and sidewalls 180. In some embodiments, course alignment may not include an actual physical interaction, but rather a visual cue for placing an ink container into a coarsely aligned position.

Alignment member 176 and alignment pocket 152 may be complementarily configured so that a fit between the alignment member and the alignment pocket progressively tightens as the ink-container lid is seated in the ink-container bay. For example, some embodiments of an alignment pocket may be configured with a cross-section area of opening 178 that is greater than a cross-section area of terminal surface 172. Furthermore, alignment member 176 can be configured with an end 182 that has a cross-section area that corresponds with the cross-section area of terminal surface 172. Therefore, end 182 may somewhat loosely fit into opening 178, yet tightly fit when fully seated towards terminal surface 172. As the alignment member and the alignment pocket are more completely mated with one another, the fit between the alignment pocket and the alignment member may progressively tighten. In some embodiments, an end of an alignment member may include a slight taper or round over that facilitates initiating alignment contact with an alignment pocket.

A progressive alignment system can be used to ensure that aspects of ink-container lid 122 are properly aligned with corresponding features of ink-container bay 170. In other words, the fit between the alignment pocket and the alignment member may be designed to achieve a desired level of tightness before an aspect of the interface package (e.g. ink-interface, air-interface, keying pocket, electrical interface, etc.) engages a corresponding aspect of an ink-container bay. Progressive alignment may also facilitate initiation of alignment because there is a greater tolerance in ink container positioning at the beginning of seating compared to when the ink container is fully seated into the ink-container bay. Once alignment is initiated, the ink container may be effectively directed into a desired location with a desired orientation with increasing precision. Interaction between aspects of the ink container with aspects of the ink-container bay can be designed to initiate when the desired level of precision has been achieved. The progressive alignment system described above is provided as a nonlimiting example. Other progressive alignment systems may be used. Furthermore, some embodiments may utilize nonprogressive alignment systems.

FIG. 5 shows an exemplary keying pocket 154 configured to ensure that an ink container is seated in a proper ink-container bay. Each bay of an ink supply station may be adapted to receive an ink container holding a particular printing fluid (type of ink, color of ink, fixer, preconditioner, etc.).

For example, each ink-container bay may include a key post of unique shape and/or orientation corresponding to the color of ink that that ink-container bay is adapted to receive. Similarly, an ink container holding that color of ink can include a keying pocket that restrictively mates with a corresponding key post associated with that color. A key post may mate with a keying pocket in a mutually exclusive relationship, meaning that a key post associated with one color of ink would not mate with a keying pocket associated with a different color of ink, or another type of printing fluid. In other words, each color of ink may be keyed by a uniquely configured key post and keying pocket combination. In this manner, a characteristic of the keying pocket of a printing-fluid container may designate the printing fluid held by the container.

A keying pocket can be used to provide physical validation that a fluid container is being inserted into the proper fluid-container bay. For example, a keying pocket may provide tactile feedback during an attempt to load an ink container into an ink-container bay. The keying pocket and/or key post may be configured so that the tactile feedback may be distinctly different depending on whether the ink container is being loaded in a bay set up to deliver the color of ink that the ink container is holding or a different color of ink. A keying pocket can be adapted to prohibit ink containers from being loaded into ink-container bays that do not include a key post corresponding to the keying pocket of the ink-container lid. In some embodiments, such an ink container may be loaded, however the interaction between the non complementary key post and keying pocket can generate a feel that is distinctly different than the feel of complementary keying features engaging one another. For example, there may be more resistance when inserting an ink container that includes a keying pocket that is not complementarily configured relative to the key post engaging the keying pocket.

FIGS. 9-11 show a cross-section view of keying pocket 154 receiving a key post 190 as ink container 120 is being seated into ink-container bay 170. Keying pocket 154 and key post 190 are complementarily configured based on a corresponding color of ink. A keying pocket, such as keying pocket 154, can be configured to mate with only key posts corresponding to the correct color of ink. Other ink containers may include similar keying pockets adapted to mate with different key posts associated with different colors of inks. In this manner, each color of ink a printing system is configured to deliver may be associated with a unique combination of a key post and corresponding keying pocket. Though primarily described with reference to keying a particular color of ink, it should be understood that a keying mechanism may be used to key alternative or additional aspects of printing fluids. For example, a particular type of ink, such as photo-ink, may be uniquely keyed to ensure that the proper type of ink is installed in a particular bay. Furthermore, other printing fluids, such as preconditioners and/or fixers, may be keyed to ensure that a fluid container holding such a fluid is installed into a corresponding bay that is configured to deliver such a fluid.

Alignment member 176 can be configured to engage alignment pocket 152 before key post 190 engages keying pocket 154. Therefore, the alignment member and the alignment pocket can cooperate to ensure that keying pocket 154 is properly positioned for engagement with key post 190. The alignment member may be longer than the key post in order to facilitate mating of the alignment member and the alignment pocket before mating of the key post and the keying pocket. In such embodiments, the alignment pocket may be deeper than the keying pocket. In some embodiments, the keying pocket and the alignment pocket may be configured to respectively engage a key post and an alignment member at substantially the same time. In some embodiments, the functionality of an alignment pocket and a keying pocket may be incorporated into a single feature configured to position an ink container in a desired location with a desired orientation and ensure that the ink container is seated in a proper ink-container bay.

Figure 12:
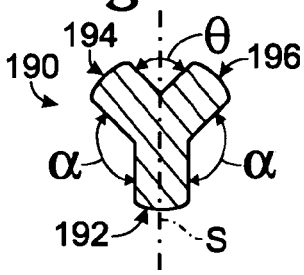
FIG. 12 shows a cross-section view of a key post configured to mate with a corresponding keying pocket of a printing-fluid container according to an embodiment of the present invention.

FIG. 12 schematically shows a cross-section view of exemplary key post 190, which is configured for insertion into complementarily configured keying pocket 154. In the illustrated embodiment, key post 190 has a "Y" configuration that includes a first spoke 192, a second spoke 194, and a third spoke 196. An angle a between first spoke 192 and second spoke 194 is the same as an angle $\alpha$between first spoke 192 and third spoke 196. An angle $\theta$ between second spoke 194 and third spoke 196 is less than angle $\alpha$. The key post may be described as being symmetrical about a symmetry axis S, which runs through first spoke 192 and bisects angle $\theta$. As illustrated, key post 190 is not symmetrical about any other axis that is coplanar with symmetry axis S.

Figure 13:
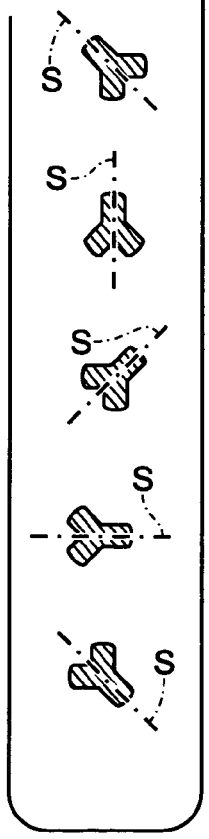
FIG. 13 shows five key posts configured to respectively key five different printing fluids.

Keying pocket 154 is shaped to mate with key post 190, so that each spoke effectively slides into a corresponding slot of the keying pocket. Unique keying interfaces may be based on the same general shape of a particular key post and keying pocket combination, but by rotating the orientation of the combination. For example, a different interface may be configured by rotating a symmetry angle of a key post that has the same general shape as key post 190. A corresponding keying pocket could be similarly rotated to produce a unique interface combination. For example, a symmetry angle can be rotated in 45° increments to yield 8 unique key post configurations. FIG. 13 shows five such configurations that may be used to key five colors of ink different than the color of ink keyed by key post 190. The above described key post and keying pocket configurations are provided as a nonlimiting example. Other keying interfaces may be used.

A keying interface may additionally and/or alternatively be varied relative to another keying interface by moving the relative position of the keying interface on an ink container and an associated ink-container bay. For example, using the example described above, in which a key post can be rotated in 45° increments to yield 8 different possible key post configurations; a location of the key post may be selected between 3 different locations to yield a total of 24 (8×3) unique key post configurations. Keying pockets with corresponding locations and orientations may be configured to mate with such key posts. If desired, additional keying configurations may be achieved by decreasing the magnitude of rotation increments, adding key post locations, adding new key post shapes, etc. For example, a key post can be rotated in 22.5° increments to yield 16 different configurations. Similarly, different key post and key pocket shapes can be used, examples of which include "T," "L," and "V" shapes.

As described above, a keying feature and/or alignment feature of an ink container may be configured as a recess that extends into the ink container as opposed to a protuberance that extends outward from the ink container. Such a recess provides a robust interface that is resistant to damage. Furthermore, configuring an ink container with a recess does not disrupt the generally planar profile of the outer-face of an ink-container lid.

FIG. 5 shows exemplary top fluidic interface 156 and exemplary bottom fluidic interface 158, which are configured to transfer ink, air, or an ink-air mixture to and/or from ink container 120. As used herein, top fluidic interface 156 may be referred to as an air-interface and bottom fluidic interface 158 may be referred to as an ink-interface. However, it should be understood that both interfaces may, in some embodiments and/or modes of operation, transfer ink, air, or a mixture thereof. In one exemplary mode of operation, bottom fluidic interface 158 may deliver a printing fluid, while top fluidic interface 156 controls pressure within the printing fluid container.

In the illustrated embodiment, the fluidic interfaces are configured as septa having a ball seal design. The fluidic interfaces are adapted to seal the contents of the ink container so that the contents do not undesirably leak. Each interface is configured to releasably receive a fluid connector, such as a hollow needle, that can penetrate the selective seal of a septum and transfer fluid into and out of the ink container. The septum can be configured to prevent undesired leaking when a fluid connector is inserted and after a fluid connector has been removed. For example, the septum may closely engulf an inserted needle, so that ink or air can pass through the needle, but not between the needle and the septum.

FIGS. 14-16 show fluid connector 200 engaging air-interface 156 and fluid connector 202 engaging ink-interface 158. Alignment member 176 can be configured to engage alignment pocket 152 before the fluid connectors engage the fluidic interfaces. Therefore, the alignment member and the alignment pocket can cooperate to ensure that the fluidic interfaces are properly positioned for engagement with the fluid connectors. In other words, the alignment interface prevents the fluid connectors from engaging an undesired portion of the ink container, which could cause damage to the fluid connectors. Entry points to the fluidic interfaces can be positioned substantially coplanar with a leading plane of the ink container, as opposed to on alignment posts that extend from an outer-face of the ink container, because the alignment pocket and the alignment member cooperate to properly align the fluidic interfaces.

Figure 17:
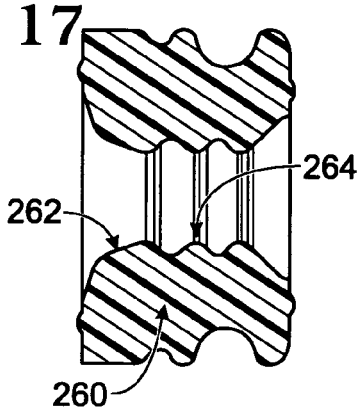
FIG. 17 shows a cross-section view of a sealing member of the printing-fluid container of FIGS. 14-16.
Figure 18:
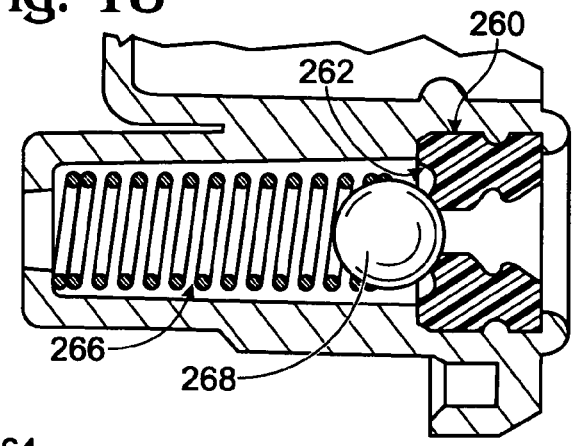
FIG. 18 is a somewhat schematic view of a ball seal mechanism of the printing-fluid container of FIGS. 14-16.
Figure 19:
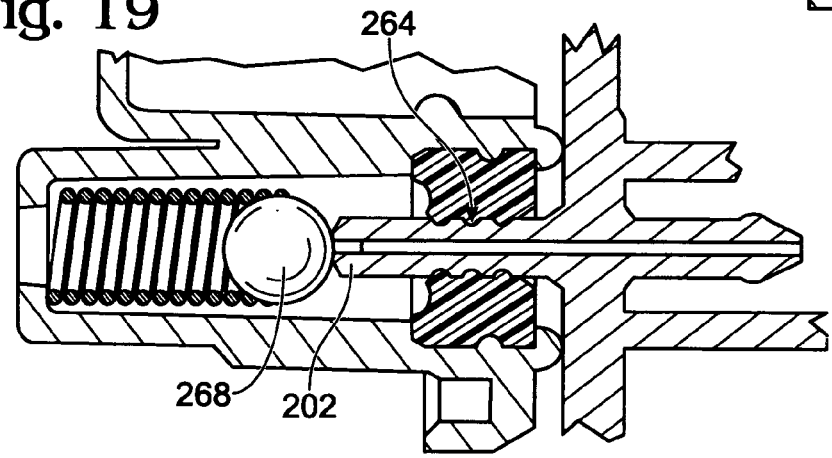
FIG. 19 shows the ball seal mechanism of FIG. 18 engaged by a fluid connector.
Figure 20:
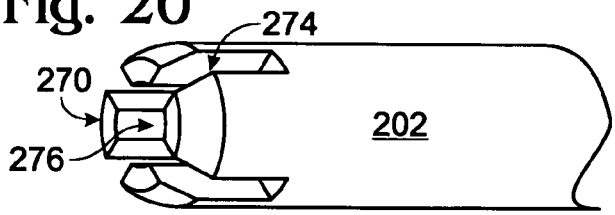
FIG. 20 shows the fluid connector of FIG. 19.

FIGS. 17-19 show a more detailed view of a sealing member 260 of fluid interface 158. Sealing member 260 includes a ball sealing portion 262 that is shaped to mate with a yieldably biased plug member to form a fluid tight seal that prevents undesired fluid leakage when the fluid interface is not engaged by a corresponding fluid connector (FIG. 18). Sealing portion 260 also includes a needle sealing portion 264 that prevents undesired fluid leakage when the fluid interface is engaged by a corresponding fluid connector (FIG. 19). As shown in FIG. 18, a spring member 266 biases a plug member 268 against ball sealing portion 262 of the sealing member. Sealing portion 262 is complementarily shaped relative to the plug member so that when the plug member is pressed against the sealing portion a fluid tight seal is established. As shown in FIG. 19, a fluid connector 202 may be inserted through sealing member 260, and the fluid connector may move the plug member away from the sealing member against a restorative force applied by the spring member. When the plug member is moved away from the sealing member, the fluid tight seal between the sealing member and the plug member is relaxed. However, a fluid tight seal between the fluid connector and the sealing member may be established. As shown in FIG. 20, fluid connector 202 may include an end portion 272 that has fluid passage features 274 that permit the flow of fluid into a hollow portion 276 of the fluid connector when the fluid connector engages the plug member. The above is provided as a nonlimiting example of a possible configuration for a fluid interface and a corresponding fluid connector. It should be understood that other mechanisms may be used to selectively seal fluid in a fluid container while remaining within the scope of this disclosure. As one example, a slit septum that self seals when a needle is removed may be used.

As shown in FIGS. 14-16, ink-interface 158 can be positioned near a gravitational bottom of an ink container that is orientated in a seated position in a corresponding ink-container bay. In such a position, fluid connector 202 is also near a gravitational bottom of the ink container. Furthermore, an ink-container reservoir body 124 can be shaped with a bottom surface 204 that slopes towards the fluid connector so that ink can naturally flow to the fluid connector. In other words, bottom surface 204 is gravitationally biased toward a low portion of the ink container. In the illustrated embodiment, the shape of the ink container produces an ink well 206 configured to allow ink to drain into position for access by fluid connector 202. By virtue of the position of the ink well relative to the remainder of the reservoir, printing fluid may accumulate in the ink well as the level of ink lowers. Fluid connector 202 can continue to draw ink occupying ink well 206 as the ink level lowers during use.

The well, ink-interface, and corresponding fluid connector may be positioned to limit the amount of ink that is stranded in the ink container, thereby minimizing waste. In some embodiments, a printing fluid container may deliver all but at most 2 cubic centimeters of printing fluid, with all but at most 1 cubic centimeter being delivered in most embodiments. As mentioned above, the size of the reservoir body may be increased, thus providing an increased ink capacity. However, such reservoirs may be configured with an ink well similar to ink well 206, or otherwise be configured so that an ink-interface is near the bottom of the reservoir, thus minimizing the amount of ink that can be stranded within the ink container. In other words, according to this disclosure, the amount of ink that may be stranded inside of an ink container does not have to be proportional to the ink capacity of the ink container.

As shown in FIG. 5, outer-face 126 of ink-container lid 122 may include a protrusion 210 at which ink-interface 158 is located. In the illustrated embodiment, protrusion 210 is configured to allow a center portion of ink-interface 158, through which a fluid connector may pass, to be positioned near a low point of the ink-container reservoir. Therefore, a fluid connector may be inserted into the fluidic interface to draw ink from a relatively low area of the ink container, thus facilitating the extraction of a greater percentage of ink from the ink container. Protrusion 210 also allows the ink-interface to be located near the bottom of the ink reservoir while remaining interior outer perimeter 128 of outer-face 126.

Figure 21:
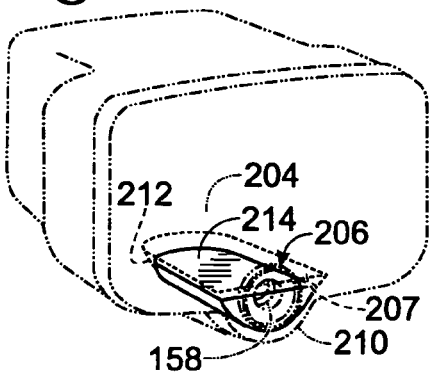
FIG. 21 schematically shows a printing-fluid level of a printing-fluid container that includes a well.

FIG. 21 somewhat schematically illustrates a protrusion 210, which aligns with a trough 212 that is recessed from a portion of bottom surface 204, thus forming a well 206. Well 206 may be gravitationally lower than the remainder of the reservoir, thus facilitating the accumulation of printing fluids in the well as printing fluids are removed from the container. In other words, a well portion 207 of the bottom surface may be recessed from a remainder of the bottom surface. To enhance the accumulation of printing fluids in well 206, bottom surface 204 may be gravitationally biased toward the well, so that printing fluids may effectively flow "downhill" to the well. Bottom surface 204 may be shaped without any false wells, which could accumulate trapped printing fluid without a fluid path to well 206.

Protrusion 210 and trough 212 may be substantially aligned with one another, as illustrated in the depicted embodiment. When so aligned, an outline of the downward edge of the leading surface traces an outline of the downward edge of the bottom surface. Protrusion 210 and trough 212 may be horizontally aligned relative to ink-container lid 122. The protrusion and trough may additionally or alternatively be horizontally aligned relative to an insertion axis of the ink-container bay. In other words, the protrusion may be positioned on the ink-container lid so that when the ink container is installed into a corresponding ink-container bay, the protrusion, and/or a fluid interface on the protrusion, is positioned substantially equidistant from either side of the ink-container bay.

Figure 22:
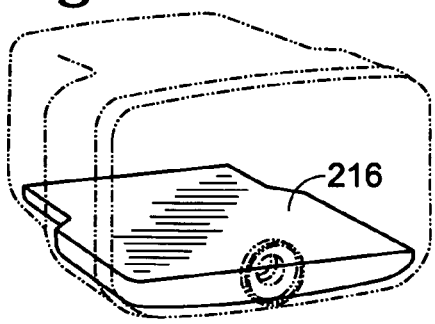
FIG. 22 schematically shows a printing-fluid level of a printing-fluid container that does not include a well.

In FIG. 21, a fluid level 214 is schematically illustrated and shows how much ink may be drawn from the printing-fluid container when the container includes a well. In contrast, FIG. 22 schematically illustrates a fluid level 216 of a container that does not include a well. As can be appreciated by comparison, well 206 limits the amount of stranded printing fluid. While the depth of fluid level 214 and fluid level 216 may be comparable, the volume of printing fluid associated with fluid level 214 is considerably less than the volume of printing fluid associated with fluid level 216. Well 206 may be configured so that the cross-sectional area of the portion of a fluid container that bounds fluid level 214 is less than the cross-sectional area of the portion of a fluid container that bounds fluid level 216, thus decreasing the respective volumes assuming similar depths. In some embodiments, well 206 may be configured to reduce the top surface area (and corresponding volume) of a fluid level that corresponds to an effectively empty fluid container by at least 75%, and usually by 90% or more. Furthermore, as mentioned above, the capacity of the remainder of an ink container may be increased without changing the size of the well and without generating an increase in the amount of printing fluid that will be stranded in the container. Well 206 may be variously sized and shaped. As a general rule, the volume of well 206 may be decreased to lessen the amount of printing fluid that may be stranded within the container. Well 206 may be sized to accommodate a fluid interface with enough additional volume to allow the free flow of printing fluid into the well.

Air-interface 156 may be positioned gravitationally above ink-interface 158 when an ink container is orientated in a seated position in a corresponding ink-container bay. Top fluidic interface 156 may function as a venting port configured to facilitate pressure equalization in the ink container. When ink is drawn from ink-interface 158, air-interface 156 may allow air to enter the ink-container reservoir to equalize the pressure therein. Similarly, if ink is returned to the ink container, the air-interface may vent air out of the ink container. As mentioned above, the top fluidic interface may be fluidically coupled to a vent chamber 90 configured to reduce ink evaporation and/or other ink loss. As described and illustrated herein, an ink container (and a corresponding ink-container bay or other mechanism for seating an ink container) may be configured for lateral installation. A configuration which facilitates lateral installation also provides design flexibility in a printing system. In particular, a lateral installation allows a printing system to be designed for front, back, or side loading of an ink container, as opposed to being restricted to top loading.

As illustrated in FIG. 2, an ink-interface may be an active interface, which is fluidically coupled to a pump 74 that is configured to control the delivery of ink to and from the ink container. An air-interface may be a passive interface, which is not directly controlled by a pump, but rather is configured to allow a pressure balance to be naturally achieved. It should be understood that the illustrated embodiment is provided as a nonlimiting example, and that other configurations are within the scope of this disclosure. For example, in some embodiments, an air-interface may be an active interface that is actively controlled to produce a desired pressure within the ink container.

FIG. 5 shows an electrical interface 160 that is configured to provide a communication and/or power path for one or more electrical devices of ink container 120. Electrical interface 160 may include one or more electrical contacts 162 that are adapted to electrically link with corresponding electrical contacts of an ink-container bay. When the ink container is seated in the ink-container bay, electric current may travel across the electrical linkage. In this manner, information and/or power may be conveyed across the linkage. For example, an ink container may include a memory device 164, and the electrical interface may be used to write data to the memory device and/or read data from the memory device. For example, a memory may be configured to store electronic keying information that can be used to validate that an ink container is loaded into an ink-container bay configured to deliver the proper printing fluid. If a mistake is detected, electronic keying may be used to disable printing to avoid contaminating the ink delivery system. The memory may also include an expiration date and/or information regarding the relative amount of ink remaining in the associated ink container. In some embodiments, an electrical interface may include additional or alternative componentry, such as an application specific integrated circuit.

Alignment pocket 152 may be positioned approximately at a center of outer-face 126, and the other interfaces of interface package 150 may be arranged around the alignment pocket. In this manner, air-interface 156, ink-interface 158, electrical interface 160, and keying pocket 154 may be positioned between the alignment pocket and outer perimeter 128. As used herein, the term "center" refers to a position relatively distal the outer perimeter of the outer-face of the ink container. The center of an outer-face of an ink container may vary depending on the size and shape of the ink container.

Positioning the alignment pocket near the center of the outer-face allows each of the other interfaces to be located relatively near the alignment pocket. Positioning alignment pocket 152 proximate the other interfaces may facilitate aligning those interfaces with corresponding features of an ink-container bay. For example, positioning the interfaces proximate the alignment pocket may decrease the effect of any tolerance that exists in the alignment interface. Therefore, if the alignment interface permits some variation in the alignment, the other interfaces may remain within an acceptable position for engaging corresponding portions of an ink-container bay. In other words, the effects of any movement allowed by the alignment interface may be amplified in proportion to the relative distance from the alignment pocket. Therefore, such effects may be minimized by positioning the various interface features proximate the alignment pocket.

As illustrated in FIG. 5, fluidic interfaces of an ink container may be located along a vertical axis V of the front surface of the printing-fluid container. Alignment pocket 152 may also be located along vertical axis V, so that vertical axis V intersects top fluidic interface 156, bottom fluidic interface 158, and alignment pocket 152. Similarly, electrical interface 160 and/or keying pocket 154 may be located along a horizontal axis H of the front surface of the printing-fluid container. Alignment pocket 152 may also be located along horizontal axis H, so that horizontal axis H intersects the electrical interface, the keying pocket, and the alignment pocket. In other words, the alignment package may be arranged in a "cross" configuration with the alignment pocket located at the center of the cross (the intersection of vertical axis V and horizontal axis H). In some embodiments, horizontal axis H may bisect the segment of vertical axis V between top fluidic interface 156 and bottom fluidic interface 158 and/or vertical axis V may bisect the segment of horizontal axis H between electrical interface 160 and keying pocket 154. Furthermore, as shown in FIG. 5, vertical axis V may be an axis of symmetry, wherein the basic shape of the fluid-container is the same to the left and right of the axis. As used with relation to an axis and an interface feature, the term "intersect" means that at least a portion of the interface feature is crossed by the axis. Therefore, a common axis may intersect two or more features, although the precise centers of such features are not aligned on the axis.

Figure 24:
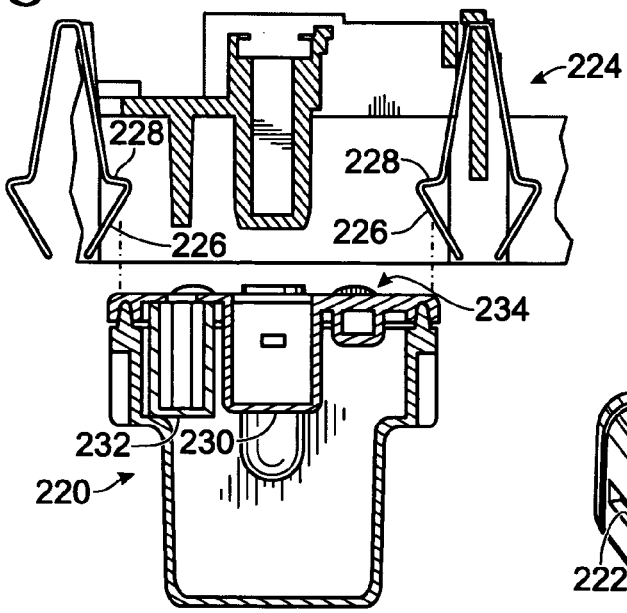
FIGS. 24-26 show top cross-section views of a printing-fluid container being seated into a printing-fluid container bay according to an embodiment of the present invention.
Figure 23:
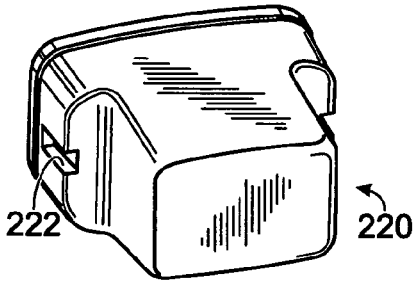
FIG. 23 shows a back isometric view of a printing-fluid container according to an embodiment of the present invention.
Figure 25:
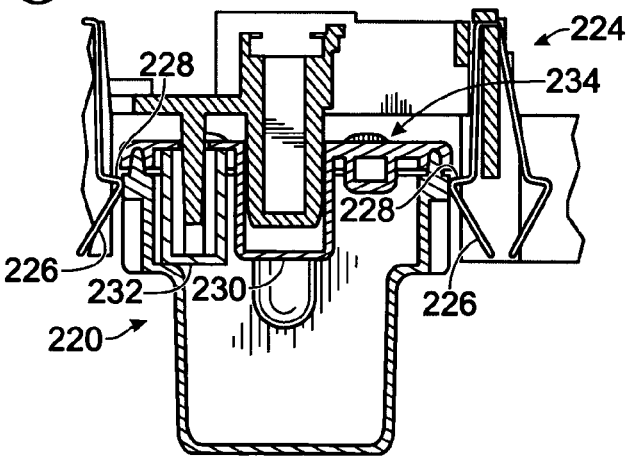
Figure 26:
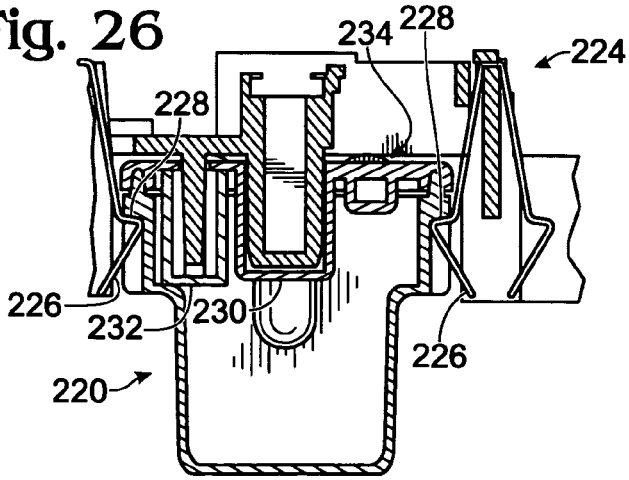

FIG. 23 shows an exemplary ink container 220 that includes latch slots 222 adapted to provide a latching surface for side-latch members of an ink-container bay. FIGS. 24-26 show ink container 220 as it engages ink-container bay 224. In the illustrated embodiment, ink-container bay 224 includes a side-latch member 226 that is configured to releasably secure the ink container in a seated position in the ink-container bay. The side-latch member may be resiliently movable between at least a closed position and an open position. For example, the side-latch member may be biased in a closed position in which the side-latch member is positioned to contact an ink container when an ink container is seated into the ink-container bay. As the ink container is moved into the ink-container bay the ink container causes the side-latch member to flex into an open position, as shown in FIG. 25. As shown in FIG. 26, the side-latch member resiliently returns to a closed position when the ink container is seated in the ink-container bay. Side-latch member 226 includes a catch 228 that engages latch slot 222, thus holding ink container 220 in a seated position in the ink-container bay. The ink container may be unseated by moving the side-latch member to an open position.

A pair of latch slots located on opposite sides of an ink container may be positioned coplanar with an alignment pocket. For example, latch slots 222 may be positioned on the same plane as alignment pocket 230. In the illustrated embodiment, the latching surfaces and alignment pocket are each intersected by a common horizontally extending plane. Keying pocket 232 and electrical interface 234 may also be positioned on the same plane. It should be understood that other latching mechanisms may be configured to apply latching pressure along a plane that passes through an alignment pocket. In some embodiments, a latch slot may be positioned on another plane that intersects an alignment pocket, such as on a vertical plane that intersects an alignment pocket and one or more fluidic interfaces.

Figure 27:
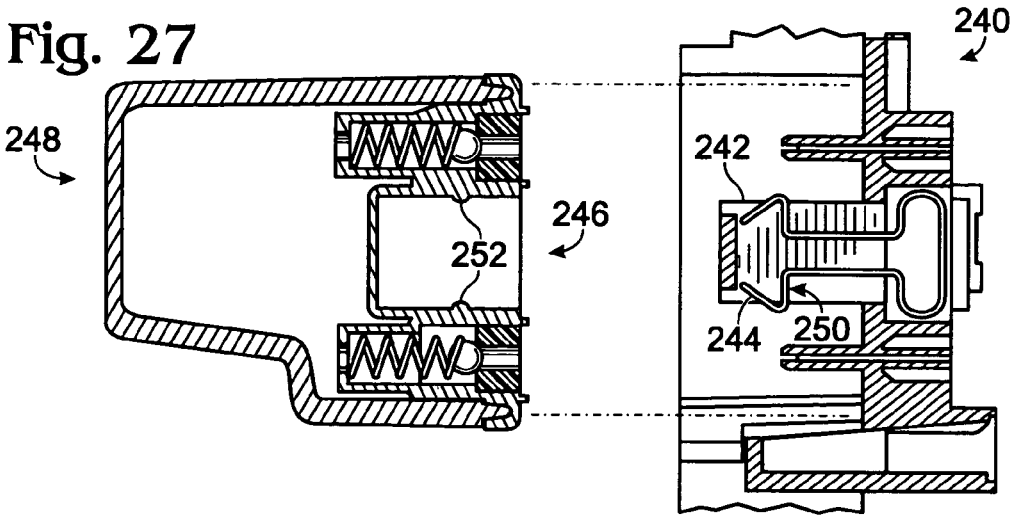
FIGS. 27-29 show side cross-section views of a printing-fluid container being seated into a printing-fluid container bay according to an embodiment of the present invention.
Figure 28:
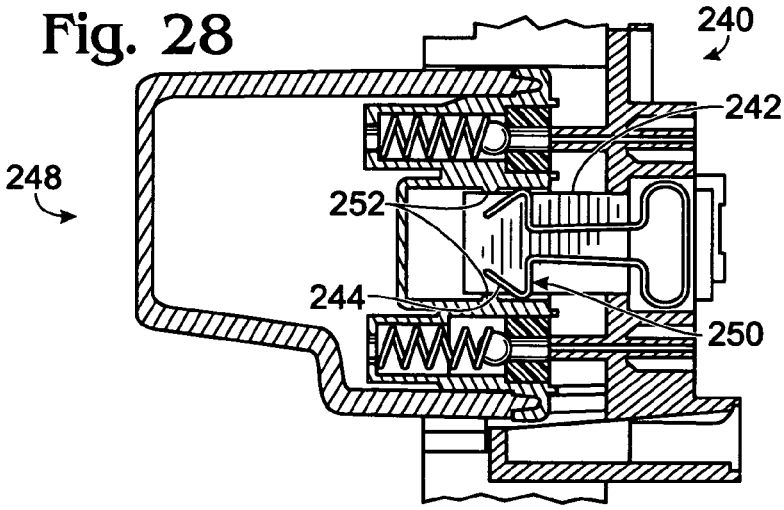
Figure 29:
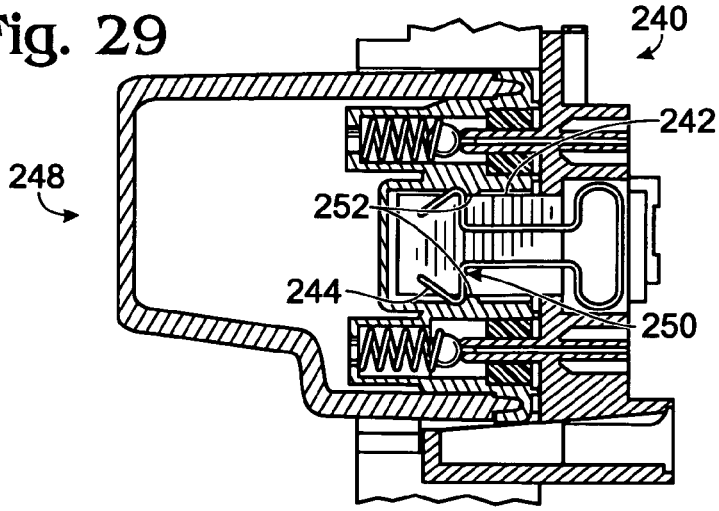

FIGS. 27-29 show another embodiment in which another latching mechanism is employed. As illustrated, an ink-container bay 240 includes an alignment member 242 that in turn includes an inner-latch member 244. Inner-latch member 244 is configured to selectively engage an alignment pocket 246 when an ink container 248 is seated in the ink-container bay. The inner-latch member may be resiliently movable between at least a closed position and an open position. For example, the inner-latch member may be biased in a closed position in which the inner-latch member is positioned to contact alignment pocket 246 when the ink container is seated into the ink-container bay. As the ink container is moved into the ink-container bay the ink container causes the inner-latch member to flex into an open position, as shown in FIG. 28. As shown in FIG. 29, the inner-latch member resiliently returns to a closed position when the ink container is seated in the ink-container bay. Inner-latch member 244 includes a catch 250 that engages a corresponding latching tab 252 of alignment pocket 246, thus holding ink container 248 in a seated position in the ink-container bay. The ink container may be unseated by moving the inner-latch to an open position.

The above described side-latch and inner-latch mechanisms are provided as nonlimiting examples of possible latching configurations. A side-latch mechanism and an inner-latch mechanism may be used cooperatively or independently of one another. Similarly, a side-latch mechanism and/or an inner-latch mechanism may additionally or alternatively be used with respect to other latching mechanisms, such as the latching mechanism described with reference to FIGS. 3 and 4. Other suitable latching mechanisms may also be used.

As described above with reference to the illustrated embodiments, an ink container may include an interface package with one or more fluidic, mechanical, and/or electrical interfaces. The ink container may be described as having a leading surface, which is configured to be laterally inserted into an ink-container bay of an ink supply station. The leading surface of an ink container may be configured as a substantially planar outer-surface. Each of the respective interfaces of the interface package may be located on the substantially planar leading surface of the ink container. The leading surface may be described as having an outer perimeter, and the respective interfaces of the interface package may be located interior the outer perimeter. The previously illustrated embodiments show a nonlimiting example of a configuration for arranging an interface package. It should be understood that other arrangements are within the scope of this disclosure.

Figure 30:
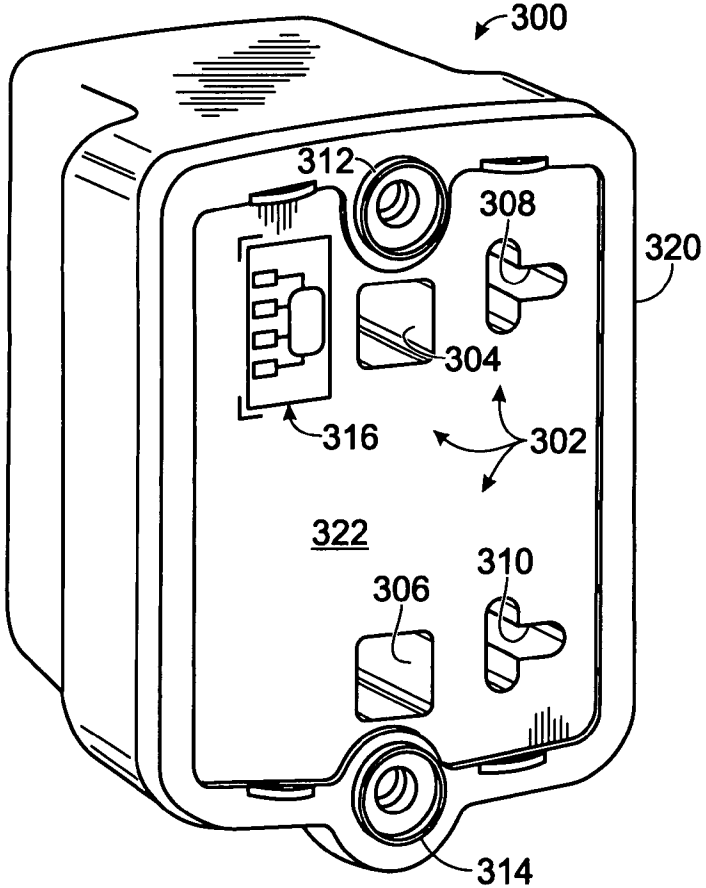
FIG. 30 shows a front isometric view of a printing-fluid including redundant interface elements.

FIG. 30 shows a printing-fluid container 300 that is relatively larger than printing-fluid container 120 of FIG. 5. In some embodiments, a large printing-fluid container may be used to hold a printing fluid that is more commonly used than other printing fluids. For example, printing-fluid container 300 may be used to hold black ink, while a smaller printing fluid container, such as printing fluid container 120 of FIG. 5, is used to hold yellow, light cyan, dark cyan, light magenta, or dark magenta ink. In some embodiments, a relatively large printing-fluid container may be used for high volume printing, thus reducing the frequency with which printing-fluid containers must be changed. Printing-fluid container 300 can include an interface package similar to interface package 150 of FIG. 5. However, as illustrated in FIG. 30, printing-fluid container 300 may be configured with one or more additional interface elements. In particular, printing fluid container 300 can be configured with redundant interface elements. For example, an interface package may include two or more alignment pockets and/or two or more keying pockets. Although described with reference to a relatively large, black-ink, printing-fluid container, it should be understood that other printing-fluid containers may be configured with redundant interface elements.

Printing-fluid container 300 includes an interface package 302 that comprises a top alignment pocket 304, a bottom alignment pocket 306, a top keying pocket 308, a bottom keying pocket 310, a top fluidic interface in the form of an air-interface 312, a bottom fluidic interface in the form of an ink-interface 314, and an electrical interface 316. Interface package 302 is positioned interior an outer perimeter 320 of a leading surface 322 of printing-fluid container 300. In other words, the constituent features of interface package 302 are not positioned around a lateral edge of the leading surface, or elsewhere on the reservoir body.

Redundant alignment pockets can improve alignment of a printing-fluid container in a printing-fluid container bay. As mentioned above, tolerances in an alignment interface increase in relation to the distance away from the alignment interface. Therefore, positioning a keying pocket and/or a fluidic interface near an alignment pocket can improve the alignment of such interface elements. Therefore, placement of an alignment pocket near an air-interface at the top of a printing-fluid container and near the ink-interface at the bottom of the printing-fluid container can improve alignment of the air-interface and ink-interface. In the case of a relatively small printing-fluid container, the same alignment pocket can be near the ink-interface and the air-interface. However, a larger printing-fluid container can be designed with a relatively tall leading surface on which the fluidic interfaces are arranged. Therefore, in order for each fluidic interface to be placed within a desired distance of an alignment pocket, separate alignment pockets can be positioned near each fluidic interface.

Redundant alignment pockets can also improve alignment of a printing-fluid container in a printing-fluid container bay by providing two or more independent alignment locations. In order for printing-fluid container 300 to be seated in a corresponding printing-fluid container bay that includes two complimentary alignment members, top alignment pocket 304 and bottom alignment pocket 306 independently engage respective alignment members. While a small alignment tolerance may be independently present in either alignment interface, such tolerance can be minimized by other alignment pockets that engage corresponding alignment members. In other words, the relative position of the various alignment pockets corresponds to the relative position of the alignment members; not only must each alignment member independently be positioned to engage a corresponding alignment member, all alignment pockets must collectively be properly positioned. If the printing-fluid container has an improper orientation, one or more of the alignment pockets will not be poised for engaging the corresponding alignment member. Therefore, the alignment pockets collectively assist the printing-fluid container into a proper position and orientation by engaging the alignment members.

Redundant keying pockets can provide additional keying selections. As mentioned above, shape, orientation, and/or position of a keying pocket may be varied to designate different printing fluids. For example, as shown in FIG. 13, a keying pocket with a "Y" shape can have one of several different orientations that designate different printing fluids. Two or more keying pockets can be shaped and orientated to provide even more possibilities. For example, two "Y" shaped keying pockets that each have one of eight possible orientations can collectively designate sixty-four different printing fluids. In other words, for each of the eight possible orientations for a top keying pocket, a bottom keying pocket can have one of eight possible orientations. Accordingly, each individual keying pocket can designate eight different printing-fluids, while the collective orientation of both keying pockets can designate sixty-four different printing fluids. Further variations can be achieved by using keying pockets with different shapes, using more unique orientations for a particularly shaped keying pocket, and/or varying location of a keying pocket. Furthermore, three or more keying pockets can be provided to provide still further possible variations.

In some embodiments, redundant keying pockets may be identically shaped, and identically positioned relative to adjacent interface elements. For example, as shown in FIG. 30, top keying pocket 308 and bottom keying pocket 310 have identical "T" shapes, which also have the same orientation. Furthermore, top keying pocket 308 is horizontally aligned with top alignment pocket 304, and bottom keying pocket 310 is horizontally aligned with bottom alignment pocket 306. The distance between top keying pocket 308 and top alignment pocket 304 is the same as the distance between bottom keying pocket 310 and bottom alignment pocket 306. Consequently, top keying pocket 308 is vertically aligned above bottom keying pocket 310. Though illustrated as having redundant keying pockets that have the same shape and orientation, it should be understood that different shapes and/or orientations are within the scope of this disclosure.

Figure 31:
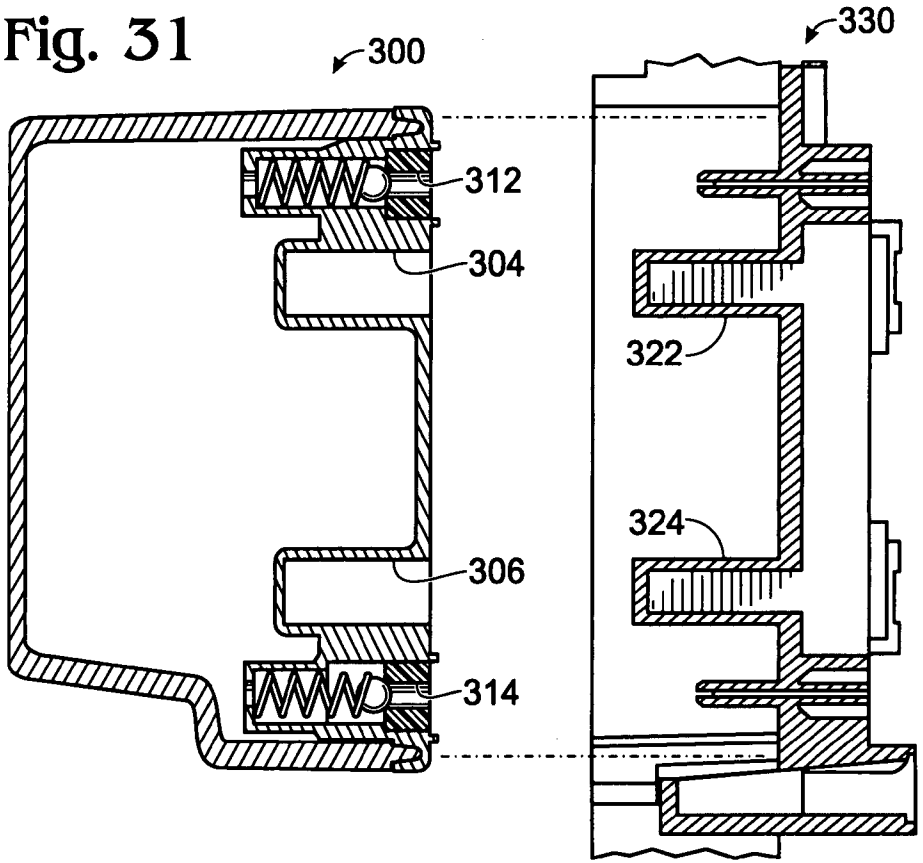
FIG. 31 shows a side cross-section view of the printing-fluid container of FIG. 30 being seated into a printing-fluid container bay according to an embodiment of the present invention.

FIG. 31 is a side cross-section view showing printing-fluid container 300 aligned for docking in a corresponding printing-fluid container bay 330. As described above with reference to FIGS. 14-16, a printing-fluid container can be laterally installed, thus allowing a front-loading system. A comparison with FIG. 14 shows that seating printing-fluid container 300 is substantially similar to seating printing-fluid container 120. As described above with reference to FIGS. 14-16, printing-fluid container 300 can be progressively aligned, so that the position and orientation of the printing-fluid container is controlled with increasing precision as it is more completely seated in a printing-fluid container bay.

Printing-fluid container bay 330 can be configured with redundant mating elements to accommodate printing-fluid container 300. For example, printing-fluid container bay 330 includes a top alignment member 332 and a bottom alignment member 334, which are configured to respectively engage top alignment pocket 304 and bottom alignment pocket 306. Printing-fluid container bay 330 also includes a top key post and a bottom key post that respectively engage top keying pocket 308 and bottom keying pocket 310. Redundant interface elements of a printing-fluid container can be configured to simultaneously (or at least substantially simultaneously) engage corresponding elements of the printing-fluid container bay. For example, alignment pocket 304 and alignment pocket 306 can be configured to mate with alignment members 332 and alignment member 334 at approximately the same time. In some embodiments, redundant interface elements may be offset, thereby effectively staggering mating of such elements with corresponding structure of the printing-fluid container bay. Such staggered mating can provide progressive alignment, multi-layer keying, and/or other functionality.

Although the present disclosure has been provided with reference to the foregoing operational principles and embodiments, it will be apparent to those skilled in the art that various changes in form and detail may be made without departing from the spirit and scope defined in the appended claims. The present disclosure is intended to embrace all such alternatives, modifications and variances. Where the disclosure or claims recite "a," "a first," or "another" element, or the equivalent thereof, they should be interpreted to include one or more such elements, neither requiring nor excluding two or more such elements.

What is claimed is:

1. An off-axis printing-fluid container configured to hold a volume of printing fluid, comprising:

a front face, wherein the front face includes a top edge, a bottom edge, a right edge, and a left edge;

a body defining an inner cavity, wherein the front face and the body are exterior the inner cavity;

an air interface passing into the inner cavity through the front face;

a printing-fluid interface passing into the inner cavity through the front face, wherein the air interface passes into the inner cavity through the front face proximate the top edge and distal the bottom edge, and the printing-fluid interface passes into the inner cavity through the front face proximate the bottom edge and distal the top edge;

a first recessed portion of the front face extending but not opening into the inner cavity of the body; and a second recessed portion of the front face extending but not opening into the inner cavity of the body, wherein the first recessed portion is intermediate the air interface and the printing- fluid interface and is proximate the air interface, and wherein the second recessed portion is intermediate the air interface and the printing-fluid interface and is proximate the printing-fluid interface.

2. The off-axis printing-fluid container of claim 1, further comprising an electrical interface on the front face intermediate the first recessed portion and the left edge.

3. The off-axis printing-fluid container of claim 2, wherein the electrical interface and the first recessed portion are coincident with an axis extending across the front face perpendicular to the left edge.

4. The off-axis printing-fluid container of claim 1, wherein the air interface, the printing-fluid interface, the first recessed portion and the second recessed portion are each coincident with an axis across the front face.

5. The off-axis printing-fluid container of claim 1, further comprising a third recessed portion of the front face intermediate the first recessed portion and the right edge and a fourth recessed portion of the front face intermediate the second recessed portion and the right edge.

6. The off-axis printing-fluid container of claim 5, wherein the third recessed portion and the fourth recessed portion extend into the inner cavity of the body.

7. The off-axis printing-fluid container of claim 6, wherein the third recessed portion and the fourth recessed portion extend at least approximately 12 millimeters from the front face into the inner cavity of the body.

8. The off-axis printing-fluid container of claim 5, wherein the third recessed portion and the fourth recessed portion each comprise a keying feature.

9. The off-axis printing-fluid container of claim 1, wherein the body includes a rear portion having a width less than a width of the front face.

10. The off-axis printing fluid container of claim 1, wherein the body includes a latching surface spaced rearward the front face.

11. The off-axis printing-fluid container of claim 10, wherein the latching surface is intermediate the front face and the rear portion.

12. The off-axis printing-fluid container of claim 11, wherein the latching surface is substantially parallel to the front face.

13. The off-axis printing-fluid container of claim 1, wherein the first recessed portion and the second recessed portion extend at least approximately 15 millimeters from the front face into the inner cavity of the body.

14. The off-axis printing-fluid container of claim 1, wherein the inner cavity is defined entirely within the body.

15. The off-axis printing-fluid container of claim 1, wherein a single structural piece forms the front face.

16. The off-axis printing-fluid container of claim 1, wherein the bottom edge includes a protruding portion extending away from the top edge and aligned with the air interface, the first recessed portion, the second recessed portion, and the printing-fluid interface.

17. The off-axis printing-fluid container of claim 1, wherein one or both of the first recessed portion and the second recessed portion comprises an alignment feature.

18. The off-axis printing-fluid container of claim 1, wherein one or both of the first recessed portion and the second recessed portion comprises a keying feature.

19. The off-axis printing-fluid container of claim 1, wherein the first recessed portion comprises an alignment feature and the second recessed portion comprises a keying feature.

20. The off-axis printing-fluid container of claim 1, wherein the first recessed portion and the second recessed portion each comprise an alignment feature.

21. The off-axis printing-fluid container of claim 1 further comprising a free volume of printing fluid held within the inner cavity.

22. The off-axis printing-fluid container of claim 1, wherein the first recessed portion and the second recessed portion each have an unblocked opening, an imperforate bottom floor opposite the opening and side walls extending from the bottom floor to the opening, the side walls being integrally formed as a single unitary body with the bottom floor.

23. The off-axis printing-fluid container of claim 1, wherein the first recessed portion is hollow and configured to receive a first post of an ink container bay when positioned in the ink container bay such that the first post projects within the first recessed portion into the inner cavity and wherein the second recessed portion is hollow and configured to receive a second post of the ink container bay when positioned in the ink container bay such that the second post projects within the second recessed portion into the inner cavity.

24. The off-axis printing-fluid container of claim 1, wherein the first recessed portion and the second recessed portion are each hollow and have a non-circular cross-sectional shape.

* * * * *